United States Patent [19]

Takagi

[11] 4,047,511

[45] Sept. 13, 1977

[54] PERFECT FUEL GASIFICATION DEVICE FOR USE IN COMBINATION WITH A COMBUSTION APPARATUS OF INTERNAL COMBUSTION ENGINE

[75] Inventor: Kazumi Takagi, Fuji, Japan

[73] Assignee: Takagi Sangyo Kabushiki Kaisha, Fuji, Japan

[21] Appl. No.: 527,233

[22] Filed: Nov. 26, 1974

[30] Foreign Application Priority Data

Dec. 1, 1973 Japan ..... 48-139247

[51] Int. Cl.[2] ..... F02M 31/00

[52] U.S. Cl. ..... 123/122 G; 123/179 H; 123/122 D

[58] Field of Search ..... 123/122 G, 122 R, 179 H, 123/119 C, 122 D; 261/141

[56] References Cited

U.S. PATENT DOCUMENTS

| | | | |
|---|---|---|---|
| 1,625,312 | 4/1927 | Good | 123/122 G |
| 1,625,313 | 4/1927 | Good | 123/122 G |
| 1,722,288 | 7/1929 | Good | 123/122 G |
| 1,789,362 | 1/1931 | Good | 123/122 G |
| 2,993,487 | 7/1961 | Konrad | 123/122 G |
| 3,024,777 | 3/1962 | Baker | 123/122 G |

*Primary Examiner*—Ronald H. Lazarus
*Attorney, Agent, or Firm*—Holman & Stern

[57] ABSTRACT

A perfect fuel gasification device for use in combination with a combustion apparatus in which there is provided a hollow cylindrical main body divided into a plurality of operation zones, an air or fuel conduit extending from and in fluid communication with said main body, fuel intake-spraying or intake-heating-spraying means and air heating means wherein liquid fuel is heated to a temperature below its boiling point under a high pressure, with the heated fuel being introduced into the spray means in a mist form to provide a wide contact surface and the fuel mist being mixed with an elevated temperature air to be perfectly gasified thereby.

2 Claims, 4 Drawing Figures

8
7
1
6
5
4
9
3
10
2

PERFECT FUEL GASIFICATION DEVICE FOR USE IN COMBINATION WITH A COMBUSTION APPARATUS OF INTERNAL COMBUSTION ENGINE

BACKGROUND OF THE INVENTION

This invention relates to a liquid fuel gasification device for a liquid fuel combustion apparatus in which liquid fuel is sprayed in an atomized or mist form into an elevated temperature air flow under high pressure and increased whereby the fuel can be efficiently and perfectly gasified.

Liquid fuels such as petroleum-origin fuels have been burnt in various systems and the fuel combustion systems are now generally classified into the pressure-spray, vaporization and gasification systems. These fuel combustion systems have their inherent advantages and disadvantages. The pressure-spray system presents the problem relating to noise and the vaporization system presents the problem relating to slowness in response speed. The third or gasification method also has the following disadvantages because the system has been heretofore based on the conception that the fuel is simply gasified by means of heating wires or the like and these disadvantages are:

1. It takes a rather long time to remove the gas.
2. The combustion of fuel is frequently interrupted because both liquid and gas coexist in the gasification device.
3. The service life of the compenents of the gasification device is relatively short because the fraction having a high boiling point remains in the gasification device.
4. Consumption of electric energy is substantial because the fuel is gasified by electric heating.

SUMMARY OF THE INVENTION

Therefore, the principal object of the present invention is to provide a liquid fuel gasification device whereby liquid fuel is perfectly gasified under quiet combustion or simplified control conditions which are advantages inherent in gas combustion.

In the operation of a liquid gasification device of the invention, liquid fuel is pumped from a fuel supply source through fuel heating means to a spray nozzle by a fluid pump while combustion air is forcibly passed from the atmosphere through air heating means into a mixing or gasification zone. Thus, the liquid fuel is passed through the fuel heating means maintained at a predetermined pressure. The purpose of heating the liquid fuel is to more effectively gasify the fuel which has been sprayed through a spray nozzle and the purpose of pressurizing the fuel is to atomize the fuel into substantially fine particles at the time when the fuel is sprayed through the nozzle and also is based on the finding that the fuel will not boil easily under any pressure, that is, although the higher the temperature of fuel is in the heating means, the more effective the gasification of fuel is, if it is not allowed to raise the temperature of the fuel to its boiling point within the heating means. The reason is that if the fuel is gasified in the heating means, the sprayed amount of the fuel through the spray nozzle is substantially reduced and the passage between the heating means and spray nozzle is liable to be clogged with the fraction of high molecular weight. Thus, even when the fuel is heated under a high pressure condition, the fuel will be seldom gasified to its boiling point as occurs when the fuel is heated to a high temperature under atmospheric pressure conditions. The thus heated and pressurized liquid fuel is then fed to the spray nozzle from which the fuel is sprayed in a fine particle or atomized form into the atmosphere. Since the fuel sprayed in the fine particle form is at an elevated temperature, the size of the fuel particles is substantially finer than that of fuel particles when the same fuel is sprayed at normal temperature and since the pressure of the individual fuel particles is instantly reduced to the atmospheric pressure when the fuel is sprayed, a substantial portion of the sprayed fuel is instantly gasified. However, the instant gasification of fuel presents problems, i.e., one of the problems is that when the fuel particles are gasified, the particles will be deprived of heat of vaporization. If the liquid fuel has imparted thereto an amount of heat sufficient to increase the fuel temperature to its boiling point and a heat amount sufficient to compensate for the lost heat of vaporization, while the fuel is within fuel pressurizing and heating means, there may be no difficulty, but in fact, in order to obtain conditions under which the fuel is heated without causing to gasify up to its boiling point within the pressurizing and heating means, it requires a substantial amount of pressure and is impractical. In such a case, an important impediment is that the boiling point varies within a wide range depending upon the type of fuel employed. In other words, liquid fuels employed in combustion apparatus are generally obtained by fractionating petroleum and refining the fraction, but the boiling point of the fraction varies depending upon the type of fuel and even one type of fuel has a widely varying boiling point range. When considered from the view point of components, the petroleum fuel is a hydrocarbon compound having lower and higher molecular weight components co-existing therein and in general, the higher molecular weight components have higher boiling points. Thus, it can be said that lower molecular weight components will boil easily while higher molecular weight components will hardly boil. If the heating means is designed to heat the liquid fuel under conditions suitable for higher molecular weight components in the fuel, the lower molecular weight components in the fuel would boil in the heating means and as a consequence, the heating conditions in the heating means are necessarily determined based on the properties of the lower molecular components.

Also to take differential pressure, when the amount of heat lost by heat of vaporization is taken into consideration, it is apparent that higher molecular weight components will not be perfectly gasified.

In order to compensate for the deficiency of the amount of heat, a heating means for heating combustion air is employed. More particularly, as to the temperature of air in the atmosphere, there also exists the phenomenon that as the air temperature is increased, saturated vapor pressure changes and the phenomenon is also applicable to liquid fuel. In short, there exists the natural phenomenon that the total amount of liquid fuel allowable to be present in air at room temperature is substantially greater than that of liquid fuel allowable to be present in air at an elevated temperature.

On one hand, when sprayed by a spray nozzle, it may be assumed that the liquid fuel will take the three different phases, that is, gaseous phase, phase just prior to gaseous phase and mist phase. In any one of these phases, the liquid phase is released in a fine particle form into the air. In other words, it means that the surface area of the liquid fuel is increased to a maximum extent and as a consequence, upon contacting an elevated temperature dry air, the liquid fuel is instantly gasified and thus, the gasification of the liquid fuel can be effected in a brief time.

Next, practical methods for carrying out this process will be described hereinbelow:

In carrying out this process, parameters such as amount of heat and pressure required to heat amounts of liquid fuel, and air to be consumed have to be previously set. These parameters vary depending upon the type of liquid fuel. However, for example, it may be assumed that the amount of necessary heat is the amount of heat obtainable from combustion; heat amount for heating air; heat amount for heating fuel are in the relationship of 100: 10: 1. However, in practice, it is necessary that these parameters be elastically determined by taking into consideration the properties of the liquid fuel employed.

Next, the practical methods for carrying out the process will be considered. In order to increase the pressure of liquid fuel, any conventional hydraulic pump can be conveniently employed and there is no difficulty in pressurizing the fuel. On the other hand, the heating of liquid fuel can be effected by any one of the following methods;

I. Heating of fuel:

1. The outer surface of a heating means is surrounded by nichrome wires.
2. Nichrome wires are provided on the inner surface or more particularly, the liquid oil receiving portion of a heating means.
3. A portion of the heat obtained from an air heating means is utilized for heating the liquid fuel.

II. Heating of air:

1. Nichrome wire heating means are provided within an air conduit down stream of a blower to heat air as the air passes by the heating means.
2. A heat accumulating material is heated by nichrome wire heating means of relatively small capacity. In the initiation of operation with a gasification device, the heat accumulated in the heat accumulating material is temporarily utilized until proper operation conditions are obtained whereupon the heat from combustion is utilized.
3. A small capacity pre-combustion means is provided within a air conduit on the downstream of a blower and the heat obtained from the pre-combustion means is employed for heating air.

The above mentioned methods are only illustrative and other methods can be also employed without departing from the spirit of the present invention. It is also within the scope of the invention to heat only air without heating liquid fuel. However, needless to say in the last-mentioned case, it takes a rather long time to perfectly gasify the liquid fuel.

Let us consider applications of the thus perfectly burnt product. The combustion product finds its applications in such combustion devices such as grills, ovens and boilers and internal combustion engines. When the gasification device of the invention is employed in combination with a combustion appliance, although liquid fuel is employed, the gasification operation with the gasification device can be quietly performed under control in the same manner as in a gasification device in which gaseous fuel is employed. The gasification device of the invention can serve a plurality of appliances by connecting the device to the appliance through an insulated piping system. When the gasification device of the invention is employed as a carburetor, since the gasification device can provide a gaseous body having greater surface area than that of the liquid in the form of a mist which is charged into the combustion chamber of a combustion device by a conventional liquid fuel gasification device, the gaseous body can mix with air satisfactorily resulting in perfect combustion. Therefore, the gasification device of the invention has advantages such as saving in fuel, reduction in carbon monoxide contained in exhaust gas and an increase of output. The air to be employed in the gasification device of the invention is combustion air. Therefore, the present invention has advantages that any external air supply source can be eliminated, since air and fuel have been previously mixed together before they are discharged into a combustion chamber, a small excess amount of air is sufficient and since any external air source is unnecessary, combustion with concentrated and intensified heating can be obtained.

The above and other objects and attendant advantages of the present invention will be more readily apparent to those skilled in the art from a reading of the following detailed description in conjunction with the accompanying drawings which show preferred embodiments of the invention for illustrative purpose only but not for limiting the scope of the same in any way.

DESCRIPTION OF PREFERRED EMBODIMENTS

Figure 1:
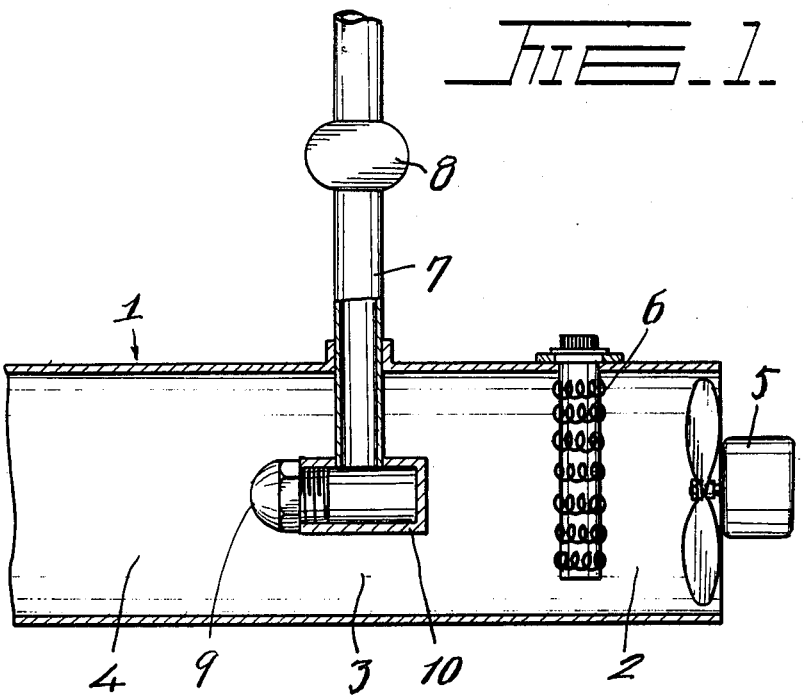
FIG. 1 is a longitudinal sectional view of a first or fundamental embodiment of liquid fuel gasification device constructed in accordance with the present invention in which atomized liquid fuel is gasified by high temperature combustion air.

The present invention will be now described referring to the accompanying drawing and more particularly, to FIG. 1 which shows a first embodiment of fuel gasification device of the invention. As shown in the figure, the fuel gasification device generally comprises a main body 1 in the form of a horizontally extending hollow cylinder which is divided into an air supply and heating zone 2, a fuel intake and spray zone 3 in communication at the right hand end (as seen in FIG. 1) with the air supply and heating zone 2, and a mixing zone 4 in communication at the right hand end (as seen in FIG. 1) with the fuel intake and spray zone 3. A blower 5 is provided at the right hand end of the air supply and heating zone 2 within the gasification device main body 1 for forcibly feeding combustion air from the air supply and heating zone 2 through the fuel intake and spray zone 3. Also provided within the air supply and heating zone 2 is a heater 6 which is suitably connected to any suitable conventional electric source (not shown) to be energized thereby and comprises nichrome wire heating elements. The heater 6 is adapted to heat the air from the blower 5 as the air passes through the air supply and heating zone 2 so as to elevate the temperature of the air to a value sufficient to burn liquid fuel discharged into the mixing zone 4. A fuel supply conduit 7 extends from any suitable conventional fuel supply source (not shown) positioned outside of the gasification device into the fuel intake and spray zone 3 and a hydraulic pump 8 is provided in the fuel conduit 7 for pumping the fuel from the fuel source into a spray nozzle 9 supported on a hollow cylindrical nozzle holder 10 which is turn supported at the lower end of the fuel conduit 7 and in fluid communication with the spray nozzle and fuel conduit. The spray nozzle 9 opens into the mixing zone 4 in the gasification device main body 1.

In operation, when the pump is actuated, fuel is pumped from the fuel source through the fuel conduit 7 into the nozzle holder 10 under pressure by the action of the pump 8 and the thus pump fuel is then sprayed through the nozzle 9 in an atomized form into the mixing zone 4.

Simultaneously, the blower 5 is actuated to forcibly pass combustion air through the air supply and heating zone 2 and the heater 6, which has been actuated, at the same time as the pump 8 and blower 5 have been actuated heats the air passing through the zone 2 to a temperature sufficient to burn the fuel. The thus heated air then passes through the fuel intake and spray zone 3 into the mixing zone 4 in which the elevated temperature air rapidly combines with and gasifies the atomized fuel issuing from the spray nozzle 9. The combined vaporized fuel and air mixture passes through the mixing zone 4 into the combustion zone of an associated combustion apparatus (not shown) in which the mixture is ignited.

Figure 2:
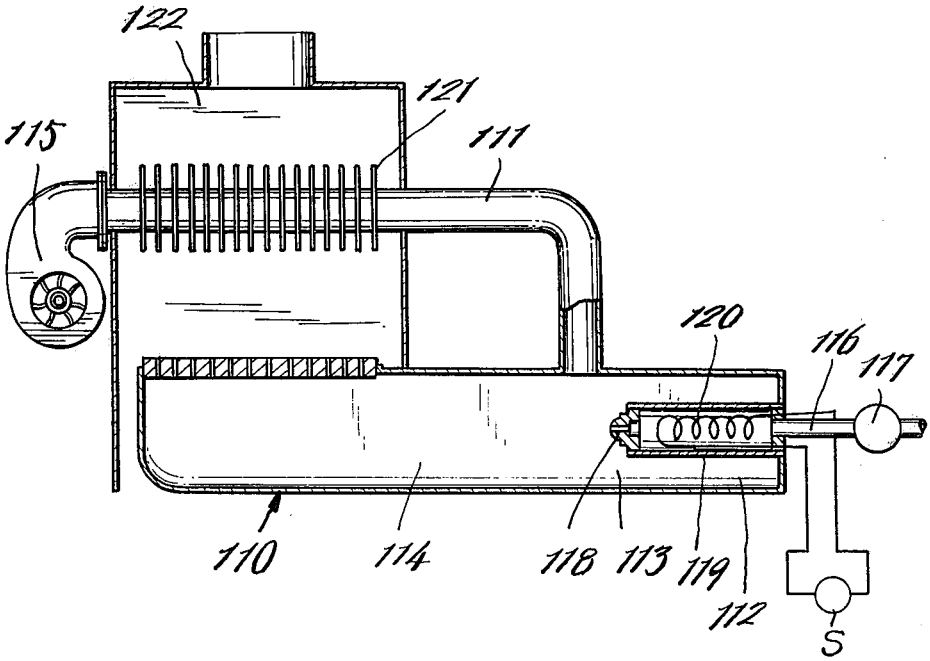
FIG. 2 is a longitudinally sectional view of a second embodiment of liquid fuel gasification device constructed in accordance with the present invention in which liquid fuel is atomized at an elevated temperature under pressure and the atomized fuel is then mixed with pre-heated combustion air whereby the fuel is perfectly gasified by the high temperature air.

Referring now to FIG. 2 which shows a second embodiment of the present fuel gasification device, the gasification device generally comprises a main body 110 in the form of a horizontally extending hollow cylinder and an air supply conduit 111 branched from the main body and extending substantially in parallel to a substantial portion of the main body. The main body 110 is divided into a fuel intake and heating zone 112, a fuel spraying zone 113 in communication at the right hand end (as seen in FIG. 2) in the fuel intake and heating zone 112 and a mixing zone 114. The branched air supply conduit 111 is communicated at one end with the juncture between the spraying zone and mixing zone 113 and 114 respectively and has a blower 115 at the other end. A fuel conduit 116 extends from the right hand end of the fuel intake and heating zone 112 to any suitable conventional fuel supply source (not shown) and a hydraulic pump 117 is provided in the fuel conduit 116 for pumping liquid fuel from the supply source through the conduit 116 into a fuel spray nozzle 118 supported by a hollow cylindrical nozzle holder 119 which is suitably mounted in the fuel intake and heating zone 112 and in fluid communication with the fuel conduit 116 and spray nozzle 118. A heater 120 comprising nichrome wire heating elements is mounted within the holder 119 in a suitably shielded condition. The heater 120 is electrically connected to a suitable electric source S to be energized thereby. An air heat exchanger 121 is provided about the air conduit 111 and comprises a plurality of fins and the heat exchanger 121 is positioned adjacent to a combustion chamber 122 of a combustion apparatus associated with the gasification device to be heated thereby.

In operation, when the hydraulic pump 117 is actuated, liquid fuel is pumped under pressure from the fuel source through the conduit 116 into the spray nozzle 118 from which the fuel is sprayed in an atomized condition. As the fuel passes by the heater 120, the fuel is directly heated to a pre-determined elevated temperature sufficient to be partially gasified by the heater 120 which has been energized simultaneously when the pump 117 has been actuated. Thus, the atomized fuel, immediately after the fuel has been sprayed through the nozzle 118, comprises a perfectly gasified component and the remaining partially gasified component.

Simultaneously, the blower 115 is actuated to forcibly pass combustion air through the air conduit 111 into the mixing zone 114 to mix with the sprayed fuel and as the air passes through the conduit 121, the air is indirectly heated through the conduit by the fins 121 which have been heated with the heat from the combustion chamber 122.

With the construction of the embodiment of FIG. 2, in the initial stage of the operation of the gasification device, the air is not heated, only the perfectly gasified component of the sprayed fuel in other words, only the component of the sprayed fuel which can be contained in the cool air is burned with the combustion air in the combustion chamber 122 and since the interior of the combustion chamber is heated as the combustion progresses, the air is heated by the temperature of the fins which have now been increased as the air passes through the conduit 111 and the heated air perfectly gasifies the sprayed fuel when the air mixes with the fuel in the mixing zone 114 to thereby increase the combustion efficiency of the fuel mixture. With the construction of the embodiment of FIG. 2, since it takes a certain time interval before a sufficiently heated air is obtained, if desired, any means which accelerates the re-gasification of the condensed fuel within the mixing zone 114 can be provided or alternatively, the air may be initially heated by a nichrome wire heater within the scope of the invention.

Figure 3:
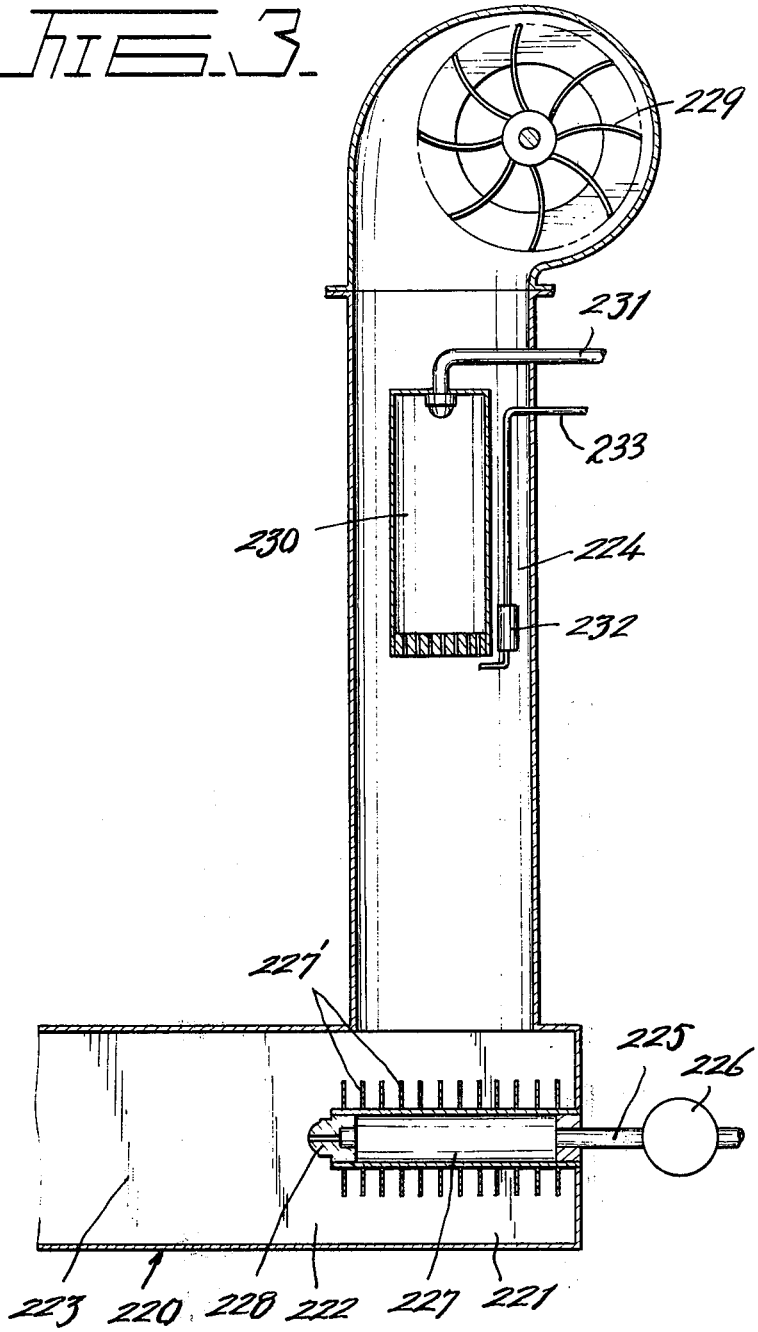
FIG. 3 is a longitudinally sectional view of a third embodiment of fuel gasification device constructed in accordance with the present invention in which combustion air is heated by the heat obtained from the combustion of fuel in a pre-combustion means and the heated air is mixed with pre-heated liquid fuel to perfectly gasify the fuel.

FIG. 3 shows a third embodiment in which the heat obtained by a pre-combustion means is utilized for heating liquid fuel. The gasification device of FIG. 3 generally comprises a main body 220 in the form of a horizontally extending hollow cylinder which is divided into a liquid fuel intake and heating zone 221, a fuel spraying zone 222 in communication at the right hand end with the fuel intake and heating zone 221 and a mixing zone 223 in communication at the right hand end with the spraying zone 222 and an air conduit 224 extending vertically and upwardly from and in communication with the fuel intake and heating zone 221. A fuel conduit 225 extends from the right hand end of the fuel intake and heating zone 221 to an external suitable fuel supply source (not shown) and a fluid pump 226 is provided in the conduit 225 for pumping liquid fuel under pressure from the supply source into a heat exchanger 227 suitably mounted within the fuel intake and heating zone 221 and having a plurality of fins 227' thereabout. A fuel spray nozzle 228 is provided at the inner end of the heat exchanger 227 for receiving the liquid fuel from the heat exchanger 227 and spraying the fuel in an atomized condition. A blower 229 is provided at the upper end of the vertical air conduit 224 for forcibly passing combustion air through the conduit 224 into the fuel intake and heating zone 221. A pre-combustion means 230 is suitably provided within the air conduit 224 and has a fuel conduit 231 extending from the top of the pre-combustion means 230 to an external fuel supply source (not shown) and an ignition means 232 is positioned adjacent to the nozzle end of the pre-combustion means 230 and electrically connected through a conductor 233 to an external electric source. The fuel to be employed in the pre-combustion means 230 may be combustible gas or kerosene, which has calories as low as one tenth that of gasified liquid but the fuel is preferably selected from those which have a rapid response to obtain satisfactory results.

In operation, when the pump 226 is actuated, the liquid fuel is pumped under pressure from the external supply source through the heat-exchanger 227 into the spray nozzle 228 from which the liquid fuel is sprayed in an atomized condition. Simultaneously, the fan 229 is actuated to forcibly pass the air downwardly into the fuel intake and heating zone 221. The pre-combustion means 230 is also simultaneously actuated to burn the combustible gas or kerosene therein and the combustion product is sprayed at the lower nozzle end thereof.

In operation, the pre-combustion means 230 is actuated to spray the combustible gas or kerosene through the lower end spray nozzle and the ignition means 232 is actuated. Simultaneously, the blower 229 is actuated to forcibly pass air through the air conduit 224 downwardly into the fuel intake and heating zone 221. Thus, the combustion gas or kerosene is ignited at the time when the fuel is sprayed from the pre-combustion means 230 whereby the air is heated. The heated air impinges against the heat exchanger 227 to heat the heat exchanger and the heat permeates through the wall of the heat exchanger. Since the heat exchanger 227 has the plurality of fins 227 thereabout, the heat exchanger has an increased heat transfer area to effect heat transfer to the fuel passing through the heat exchanger more effectively. When the temperature of the heat exchanger has reached a predetermined value, the pump 226 is actuated to pump liquid fuel under pressure from the fuel supply source through the heat exchanger into the spray nozzle 228 from which the fuel is sprayed in an atomized condition into the mixing zone 223 in which the atomized fuel mixes with the heated air from the air conduit 224. Since the heat exchanger has been sufficiently heated, the liquid fuel will have been sufficiently heated before the fuel is sprayed from the spray nozzle 228 and can be perfectly atomized as soon as the fuel is sprayed into the mixing zone. Since the temperature of the fuel will not be increased in excess of that of the heated air, no hazard will occur. It is only necessary to set the heating temperature of the combustion air to a predetermined value to thereby ensure a long service life for the entire gasification device.

Figure 4:
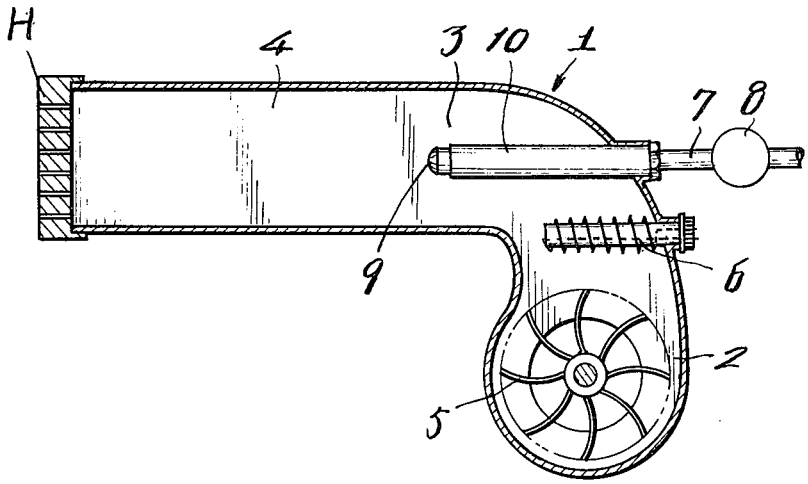
FIG. 4 is a longitudinally sectional view of a modification of the embodiment as shown in FIG. 1.

The embodiment of FIG. 4 is a modification of the embodiment of FIG. 1 and is substantially similar to that of FIG. 1 except for the disposition of the parts which are similar in function to the corresponding parts of FIG. 1 and are indicated by the same reference numerals as employed in FIG. 1. In FIG. 4, the blower 5 is provided within the downwardly extending extension of a main body 1 and the nichrome wire heating means 6 extends horizontally into the air supply and heating zone 2 above the blower 5. The fuel conduit 7 having the hydraulic pump 8 extends horizontally through the main body proper parallel to and above the heating means 6, into the fuel intake and spray zone 3, and supported in the nozzle holder 10 at the inner end of which the spray nozzle 9 is mounted in fluid communication with the fuel conduit 7. The outer end of the fuel conduit 7 is connected to and in fluid communication with a external fuel supply source (not shown). The mixing zone 4 is in fluid communication at one end with the spraying zone and at the other end in communication with the burner 4 which in turn is in communication with the combustion chamber of an associated combustion apparatus (not shown). The operation of the embodiment of FIG. 4 is identical with that of the embodiment of FIG. 1 and a description of the operation will be omitted herein.

While several embodiments of the invention have been shown and described in detail, it will be understood that the same are for illustration purpose only and not to be taken as a definition of the invention, reference being had for the purpose of the appended claims.

What is claimed is:

1. A fuel gasification-increasing device for use with fuel-combustion apparatus comprising:

a hollow, cylindrical main body having upstream and downstream ends, the interior of said main body including intercommunicating fuel-intake, combustion-air supply, heating, fuel-spraying and mixing zones in series, the mixing zone being downstream of the fuel-spraying zone, said fuel-spraying zone being defined in said main body by a liquid-fuel nozzle connected to a fuel-pressurizing means, said nozzle being directed axially in said main body toward to the downstream end thereof and having means for discharging a wide, pressurized-spray of fuel as a mist into said main body toward said downstream end, said combustion-air supply means including means for heating and forcing combustion-air into said main body into said mixing zone so that the pressurized fuel mist is substantially perfectly gasified upon entering pressurized, increased-temperature combustion-air whereby the fuel-air using combustion apparatus receives gasified fuel in an optimum condition, said combustion-air supply means comprising a vertically-extending conduit communicating with said main body, blower means connected to an upper portion of said air conduit, and pre-combustion means in said air conduit intermediately of said blower means and the main body, said fuel-pressurizing means comprising an hydraulic pump connected to said liquid-fuel nozzle, said liquid-fuel nozzle including heating means for heating the fuel pressurized by said liquid pump prior to the fuel being directed into said mixing zone, said liquid-fuel nozzle including a plurality of heat-transferring fins disposed about said nozzle for increasing the heat-conducting area of said nozzle.

2. The device as claimed in claim 1 in which said pre-combustion means comprises a chamber connected to a separate source of fuel, and ignition means operatively connected to said chamber intermediately of said air-conduit.

* * * * *